United States Patent [19]

Jackson

[11] 4,151,799

[45] May 1, 1979

[54] WAD FOR SHOTGUN SHELL

[76] Inventor: John W. Jackson, 7076 Dudley Dr., Arvada, Colo. 80004

[21] Appl. No.: 836,072

[22] Filed: Sep. 23, 1977

[51] Int. Cl.[2] ..... F42B 7/08

[52] U.S. Cl. ..... 102/95

[58] Field of Search ..... 102/42 C, 95

[56] References Cited

U.S. PATENT DOCUMENTS

| | | | |
|---|---|---|---|
| 3,262,392 | 7/1966 | Becker et al. | 102/95 |
| 3,285,174 | 11/1966 | Moehlman et al. | 102/95 X |
| 3,516,360 | 6/1970 | Lathrope et al. | 102/95 |
| 3,707,915 | 10/1970 | Kerzman | 102/95 |
| 3,722,420 | 3/1973 | Herter | 102/95 |
| 3,812,784 | 5/1974 | Herter | 102/95 |

*Primary Examiner*—Verlin R. Pendegrass

[57] ABSTRACT

A unitary plastic wad structure for use with a shotgun. The wad includes a shot cup portion and an obturating cup portion with both cups being of cylindrical configuration. The wad further includes a shock absorbing filler comprising transversely, obliquely, and longitudinally oriented planar members. The deflection characteristics of the transverse members provide the repeated attainment of a predictable shot pattern.

12 Claims, 8 Drawing Figures

WAD FOR SHOTGUN SHELL

BACKGROUND OF THE INVENTION

1. Field of the Invention

This invention relates to plastic wads used in cartridges for shotguns. In particular, the invention relates to a one-piece wad structure having an obturating disc or cup which is connected to a shot cup by a filler comprising a shock absorbing structure having improved folding or structural deflection characteristics.

2. Description of the Prior Art

It is known to provide plastic wad structures for use in shotgun shells to (1) house the shot charge, (2) obturate combustion gases, and (3) cushion the shot charge when the loaded wad is fired from the gun. It is necessary to cushion the shot charge from the impact generated by the expanding power gases upon firing. This is necessary so that the shot will be gradually set in motion. This prevents undue deformation of the shot as well as lessening maximum pressure levels required in the shell to achieve a given shot load velocity.

It is also necessary that the filler or cushioning portion of the wad structure provide a cushioning action that is uniform in order to prevent any tilting or yawing of the shot cluster.

Attempts have been made in the prior art to provide wads with improved filler or cushioning structures. These attempts however have not been successful and are characterized by devices that are less than ideal since they exhibit a nonuniform, asymmetrical and uncontrolled deformation of the cushion members. This, in turn, prevents the attainment of a controllable and predictable shot pattern.

SUMMARY OF THE INVENTION

3. Object

An object of the invention is to provide a wad having an improved filler or cushioning structure.

A further object is to provide a wad having a filler or cushioning structure that exhibits a symmetrical and controllable deformation of its various elements to provide a predictable and controllable shot pattern.

Another object is to provide a wad which provides improved external ballistics of a fired shot column to improve the resultant shot pattern.

4. Summary Description

In accordance with the invention, I provide a one-piece wad having an obturating cup which is connected to a shot cup or protector by means of an improved filler element. The filler comprises a first plurality of planar elements oriented longitudinally to the wad and a pair of planar elements oriented transversely to the wad and interconnected with a pair of said plurality of longitudinally oriented elements. The filler further comprises a pair of obliquely oriented planar elements each having a first end connected to one end of each of said transversely oriented elements and having another end connected to one of said longitudinally oriented elements. The bottom of the shot cup is connected to a pair of the longitudinally oriented elements which, in turn, are connected to the pair of the transversely oriented elements. The downward force exerted by the shot load upon firing deflects the pairs of transverse elements and obliquely oriented elements downwardly in a uniform and symmetrical manner. This prevents undue deformation of the shot and also prevents a yawing or tilting of the wad and the shot load in the barrel upon firing. These factors provide for an improved, and predictable shot pattern.

5. Features

A feature of the invention is the provision of a filler structure comprising transversely, obliquely, and longitudinally oriented planar elements arranged to provide an improved cushioning effect for a shot load.

A further feature is that the cushioning effect is provided by a symmetrical deflection of the filler members so as to promote a predictable shot pattern.

DESCRIPTION OF THE DRAWING

These and other objects and features of the invention will be better understood from a reading of the following description of an exemplary embodiment of the invention taken in conjunction with the drawing in which.

DETAILED DESCRIPTION

Figure 1:
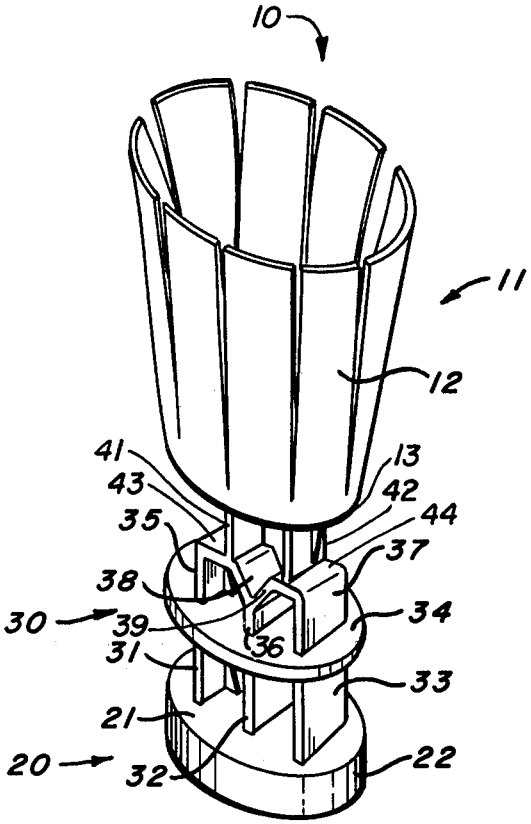
FIG. 1 is an isometric view of a wad embodying the invention.
Figure 2:
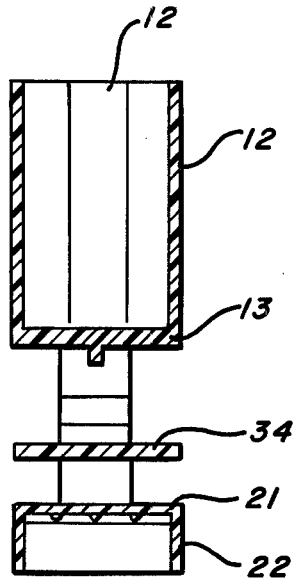
FIG. 2 is a longitudinal side sectional view of the wad of FIG. 1.
Figure 3:
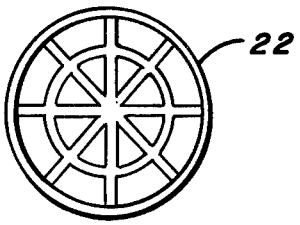
FIG. 3 is a bottom plan view of the wad of FIG. 1.

A filler or cushioning structure 10 embodying my invention is shown on the drawing FIGURES as comprising an obturating cup 20, a shot cup 11, and a filler member generally indicated by the reference numeral 30 with the filler members including the elements designated 31 through 44 inclusive. The cut 20 comprises a top circular planar surface 21 whose circumference is connected to a downward projecting flexible internally tapered wall 22. Elements 21 and 22 together comprise an obturating powder chamber.

The shot cut 11 comprises a circular planar bottom member or surface 13 and an upwardly extending wall that is segmented longitudinally to the axis of the wad to define a plurality of sections or petals 12. The reception of the wad 10 in the shell 50 of FIG. 7 brings the petals 12 into close cylindrical adjacency for receiving the individual shot elements 51 of FIG. 7.

The filler 30 comprises a planar disc 34, generally parallel to and intermediate planar surface 13 and 21. Disc 34 is integrally connected on its bottom surface to surface 21 of cup 20 by means of a center strut 32 and by the two side struts 31 and 33. The surfaces of struts 31, 32, and 33 are longitudinally parallel to each other and are generally perpendicular to disc 34 and to the top surface 21 of cup 20. Centrally located on the inner surface of struts 31 and 33 are reinforcing triangles **31*a* and 33*a*. These triangles are integral to the struts 31 and 33, respectively, as well as to the top 21 of cup 20**.

An important feature of the filler is that elements 34 and 21 together with the struts and triangles comprise a structure which is of light weight but yet is sufficiently resistant to distortion when subject to axial and radial forces. A further advantage is that the distance between the bottom of cup 20 and disc 34 is in excess of half of the diameter of elements 34 and 21. This presents a bearing surface to the interior of the shell case and shotgun bore which cannot tip or tilt and thus cannot become misaligned.

The top surface of disc 34 has integrally connected thereto the upwardly extending and longitudinally oriented planar struts 35 and 37 which may be considered to be extensions of struts 31 and 33, respectively. Center strut 36 also extends upwardly as an extension of strut 32. Each strut 35 and 37 generally projects upwardly one-half of the distance separating disc 34 and element 13. Struts 35 and 37 at their top end have integrally connected thereto an inwardly projecting transversely oriented and coplanar strut member 43 and 44, respectively. The length of each of struts 43 and 44 is generally equal to one-quarter of the distance between struts 35 and 37.

The top end of strut 36 is connected to the bottom of a "V" strut comprising the obliquely oriented elements 38 and 39 the upper ends of which are connected to the inner end of each of struts 43 and 44, respectively. Elements 38 and 39 each have a length generally equal to that of elements 43 or 44. Elements 34 and 21 and their connecting strut members form a geometrically symmetrical structure that is resistant to distortion by radial forces and yet is resilient to controlled axial forces.

The bottom 13 of cut 11 is integrally connected to a top end of longitudinally oriented planar struts 41 and 42 which project downwardly and connect at their bottom ends to the top surface of horizontal struts 43 and 44, respectively. Struts 41 and 42 are joined to struts 43 and 44, in close proximity to, but yet at a spaced apart distance from the intersection of each horizontal strut 43 and 44 with oblique struts 38 and 39, respectively.

Figure 5:
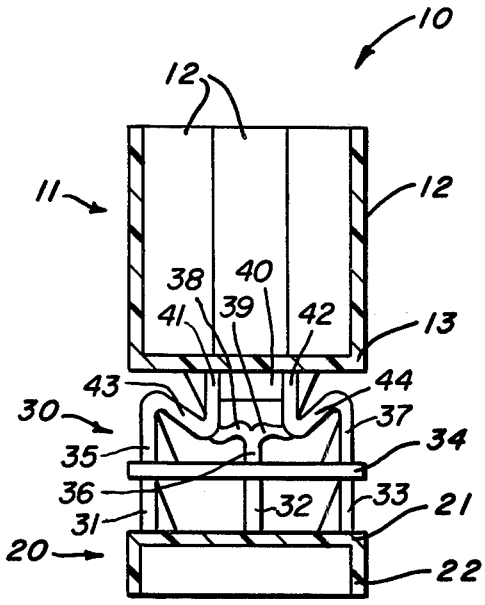
FIG. 5 is a front longitudinal sectional view showing the deflectional characteristics of the filler structure.

FIG. 5 illustrates the configuration of the filler elements when the wad is partially compressed upon assembly in the shell. It should be noted that elements 13 and 34 and their connecting strut members are self aligning on their original longitudinal axis. Elements 13 and 34 remain parallel to each other under compression. Disc 34 is an integral part of the functionally solid bottom portion of the wad and is connected by the flexible strut members 43, 38, 39, and 44 to the shot cut. Thus when under compression, the entire wad remains an axially aligned structure.

On FIG. 5, the intermediate elements 38, 39, 43, and 44 permanently deformed prior to firing and therefore continue to exert a relatively constant pressure on the power and the shot elements. This contributes to a controlled burning rate of the powder.

Figure 8:
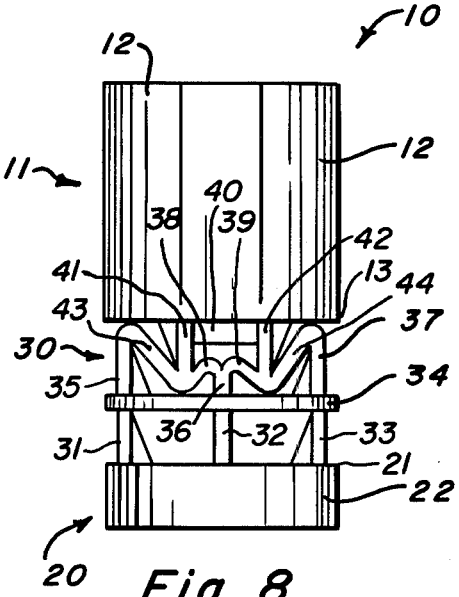
FIG. 8 shows further deflectional characteristics of the filler.

FIG. 8 illustrates the flexed state of elements 38, 39, 43, and 44 upon firing. Surface 13 contacts the upper end of struts 35 and 37; the lower ends of struts 41 and 42 bear against disc 34. The entire filler structure at this time is a rigid solid that cannot be misaligned.

Figure 4:
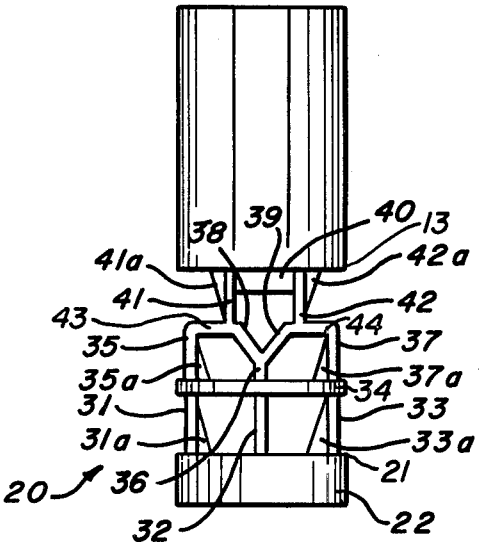
FIG. 4 is a front elevational view of the wad of FIG. 1.

Triangular members 41*a* and 42*a* and member 40 (FIG. 4) contribute to the rigidity of struts 41 and 42.

Figure 7:
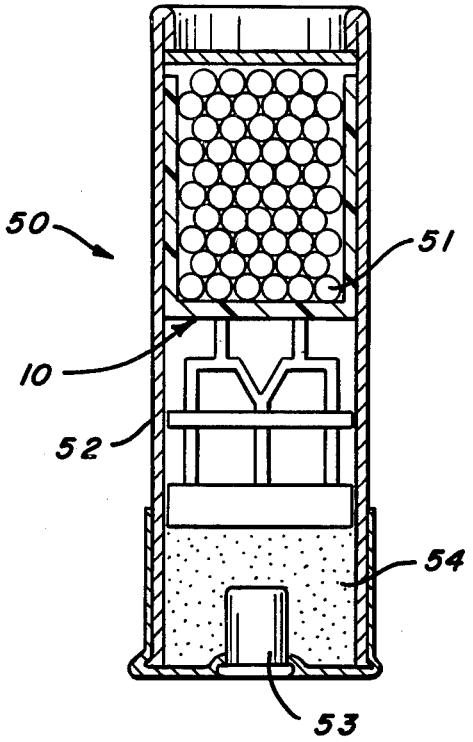
FIG. 7 illustrates a shotgun shell equipped with the wad of FIG. 1.

FIG. 7 shows the wad 10 inserted into a shotgun shell 50 having a case 52, shot 51, primer 53, and powder 54 but before the loading force deforms the elements downwardly as shown in FIG. 5.

Figure 6:
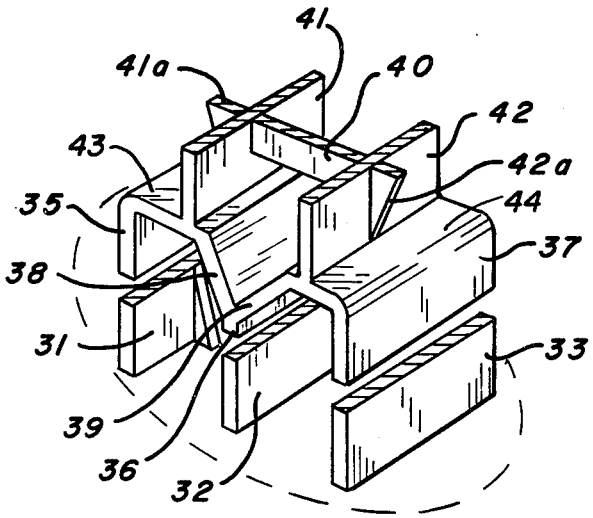
FIG. 6 is an isometric view of the filler structure.

FIG. 6 shows in expanded detail the various elements comprising the filler portion of the disclosed wad minus the disc 34.

What is claimed is:

1. In a one-piece plastic wad for a shotgun shell in which the wad includes an obturating member, a shot cup in substantial axial alignment along the longitudinal central axis of said wad and a shock absorbing filler means for connecting said obturating member and said shot cup together in spaced-apart relationship, the improvement wherein said filler comprises:

a disc disposed perpendicular to said axis and positioned intermediate said cup and said obturating member, support means for fixably connecting a bottom surface of said disc to a top surface of said obturating member, a first pair of substantially flat struts having parallel facing surfaces perpendicular to said disc with said struts being disposed substantially to the periphery of said disc on opposite sides thereof, each of said struts being fixably connected at a lower end thereof to abut a top surface of said disc, a relatively short central shrut having surfaces parallel to the parallel faces of said first pair of struts and perpendicular to said disc, said central strut being fixably connected at a lower end thereof to abut a central portion of said top surface of said disc intermediate said first pair of struts, a pair of horizontal struts having substantially coplanar top surfaces substantially parallel to said disc with each of said horizontal struts having an outer end uniquely connected to but a top end of a different one of each of said first pair of struts, each of said horizontal struts extending inwardly from its outer end towards said axis of said wad, a "v"-shaped strut comprising a pair of inwardly tapering side surfaces of a pair of planar side members whose bottom end portions are connected to abut each other as well as connected to abut a top end of said short central strut, the top open end of each side member of said "v"-shaped strut being uniquely connected to abut the inner end of a different one of said horizontal struts, and a third pair of struts being substantially vertically disposed and having facing surfaces parallel to each other as well as parallel to said surfaces of said first pair of struts, each of said third pair of structs having a top end fixably connected to abut a bottom surface of said shot cup and each further having a bottom end fixably connected to abut a top surface of a different one of said horizontal struts intermediate the ends of each of said horizontal struts, said "v"-shaped strut and said horizontal struts being flexibly deformable upon the firing of said shell so that said shot cup moves downwardly until said bottom surface of said cup contacts the top ends of said first pair of struts whereupon the inner ends of said horizontal struts contact said top surface of said disc in response to a downward force exerted by said third pair of struts.

2. The wad of claim 1 in which each of said first pair of struts are of substantially equal length with said length being approximately equal to half the distance between the top surface of said disc and said bottom surface of said cup.

3. The wad of claim 2 in which each of said horizontal struts are of substantially equal length with said length being approximately equal to one third of the distance between the parallel surface of said first pair of struts.

4. The wad of claim 3 in which each of said third pair of struts are of substantially equal length with said length being substantially equal to that of said first pair of struts.

5. The wad of claim 4 in which said support means comprises, a fourth pair of substantially flat struts having parallel facing surfaces perpendicular to said disc with each of said last named struts being substantially and uniquely coplanar to said parallel surface of a different one strut of said first pair of struts, each of said fourth pair of struts being connected at a top end thereof to abut said bottom surface of said disc and being connected at a bottom end thereof to abut a top surface of said obturating member.

6. The wad of claim 5 in which said filler further comprises a plurality of substantially triangular shaped planar members connected to form bracing means for said first and said third and said fourth pairs of struts, each strut of said first pair of struts having one side of one of said triangular bracing means connected to abut an inner surface of each strut of said first pair along the central longitudinal axis of each strut and having another side of said triangular bracing means connected to abut said top surface of said disc, said third pair of struts each having one side of one of said triangular bracing means connected to abut an inner surface of each strut of said third pair along the central longitudinal axis of each strut and having another side of said triangular bracing means connected to abut a bottom surface of said cup, each strut of said fourth pair of struts having one side of one of said triangular bracing means connected to abut an inner surface of each strut of said fourth pair along the central longitudinal axis of each strut and having another side of said bracing means connected to abut said top surface of said obturating member.

7. The wad of claim 6 in which said filler further comprises a substantially rectangularly shaped planar support member interposed between said third pair of struts and having its top side connected to abut said bottom surface of said cup and having its ends connected to abut inner surfaces of said third pair of struts.

8. In a one-piece plastic wad for a shotgun shell in which the wad includes an obturating member, a shot cut in substantial axial alignment along the longitudinal central axis of said wad and a shock absorbing filler means for connecting said obturating member and said shot cup together in a spaced-apart relationship, the improvement wherein said filler comprises;

a disc disposed perpendicular to said axis and positioned between said cup and said obturating member, support means for fixably connected a bottom surface of said disc to a top surface of said obturating member, a first pair of struts having parallel central longitudinal axial cross sections oriented perpendicular to said disc with said struts being disposed substantially to the periphery of said disc on opposite sides thereof, each of said struts being fixably connected at a lower end thereof to a top surface of said disc, a relatively short central strut having a central longitudinal cross section parallel to the central longitudinal axial cross section of said first pair of struts and oriented perpendicular to said disc, said central strut being fixably connected at a lower end thereof to a central portion of said top surface of said disc intermediate said first pair of struts, a pair of substantially horizontally disposed struts each of which has an outer end thereof uniquely connected to a top end of a different one of each of said first pair of struts, each of said horizontal struts extending inwardly from its outer end towards said axis of said wad, each of said horizontal struts having a central longitudinal axial cross section in a substantially coplanar relationship with that of the other horizontal strut and parallel to said top surface of said disc, a "v"-shaped strut comprising a pair of inwardly tapering side surfaces of a pair of side members whose bottom end portions are connected to abut each other as well as connected to abut a top end of said short strut, the top open end of each side of said "v"-shaped strut being uniquely connected to abut the inner end of a different one of said horizontal struts, and a third pair of struts being substantially vertically disposed and having parallel central longitudinal axial cross sections with each of said last named struts having a top end fixably connected to a bottom surface of said shot cup and each further having a bottom end connected to a top surface of a different one of said horizontal struts intermediate the ends of said horizontal struts, said "v"-shaped strut and said horizontal struts being flexibly deformed upon the firing of said shell so that said shot cup moves downwardly until the bottom surface of said cup contacts the top ends of said first pair of struts whereupon the inner ends of said horizontal struts contact the top surface of said disc in response to a downward force exerted by said third pair of struts.

9. The wad of claim 8 in which each of said first pair of struts are of substantially equal length with said length being approximately equal to half the distance between said top surface of said disc and said bottom surface of said cup.

10. The wad of claim 9 in which each of said horizontal struts are of substantially equal length with said length being approximately equal to one third of the distance between parallel surfaces of said first pair of struts.

11. The wad of claim 10 in which each of said third pair of struts are of substantially equal length with said length being substantially equal to that of said first pair of struts.

12. The wad of claim 11 in which said support means comprises, a fourth pair of substantially verticaly disposed struts having parallel central longitudinal axial cross sections perpendicular to said disc with a central longitudinal axial cross section of each of said last named struts being substantially and uniquely copolanar to a central longitudinal axial cross section of a different one strut of said first pair of struts, each of said fourth pair of struts being connected at a top end thereof to abut said bottom surface of said disc and being connected at a bottom end thereof to abut a top surface of said obturating member.

* * * * *